United States Patent [19]

Schnurle et al.

[11] 4,187,806

[45] Feb. 12, 1980

[54] FUEL-AIR MIXTURE CONTROL APPARATUS

[75] Inventors: Hans Schnurle, Walheim; Rudi Mayer, Vaihingen; Bernd Kraus, Gerlingen, all of Fed. Rep. of Germany

[73] Assignee: Robert Bosch GmbH, Stuttgart, Fed. Rep. of Germany

[21] Appl. No.: 799,489

[22] Filed: May 23, 1977

[30] Foreign Application Priority Data

May 22, 1976 [DE] Fed. Rep. of Germany ..... 2623113
Oct. 29, 1976 [DE] Fed. Rep. of Germany ..... 2649456

[51] Int. Cl.[2] ..... F02B 3/00

[52] U.S. Cl. ..... 123/32 EE; 60/276; 123/32 ED

[58] Field of Search ..... 123/32 EA, 32 ED, 32 EE, 123/119 EC; 60/276, 285

[56] References Cited

U.S. PATENT DOCUMENTS

| | | | |
|---|---|---|---|
| 3,745,768 | 7/1973 | Zechnall et al. | 60/276 |
| 3,771,502 | 11/1973 | Reddy | 123/32 EA |
| 3,782,347 | 11/1974 | Schmidt | 60/285 |
| 3,815,561 | 7/1974 | Seitz | 123/32 EE |
| 3,875,907 | 4/1975 | Wessel et al. | 123/32 EE |
| 3,903,853 | 9/1975 | Kizler et al. | 123/32 EE |
| 3,919,981 | 11/1975 | Reddy | 123/32 EA |
| 4,088,095 | 5/1978 | Aono | 123/119 EC |
| 4,089,313 | 5/1978 | Asawo et al. | 123/32 EE |
| 4,099,491 | 7/1978 | Reddy | 123/32 EE |
| 4,120,269 | 10/1978 | Fujishiro | 123/119 EC |

*Primary Examiner*—Samuel W. Engle
*Assistant Examiner*—S. A. Cangialosi
*Attorney, Agent, or Firm*—Edwin E. Greigg

[57] ABSTRACT

Circuitry is described for use with a fuel mixture control system of an internal combustion engine in which an oxygen sensor is located in the exhaust system and generates a generally bi-valued signal which is compared with a set-point voltage to indicate rich or lean mixtures. In order to permit control loop operation even when the sensor signal changes due to decreasing temperatures, the set point voltage is adjusted to remain between the two values of the sensor signal. This adjustment is effective only when the lower sensor signal exceeds a given limit.

10 Claims, 4 Drawing Figures

FUEL-AIR MIXTURE CONTROL APPARATUS

BACKGROUND OF THE INVENTION

The invention relates to a control mechanism for regulating the fuel-air mixture supplied to an internal combustion engine. The invention relates more particularly to a control mechanism of this type which also includes a sensor for detecting the composition of the exhaust gas and for generating a suitable signal related thereto and a comparator circuit which compares the output signal from the oxygen sensor with a set point or threshold signal. The resultant signal would be supplied to a subsequent mixture preparation system which includes a variety of electronic circuitry for adaptation of the mixture to other requirements. The exhaust gas sensor is an oxygen sensor of the type which provides an output signal that alternates between a high and a low voltage depending on whether the exhaust gas contains excess oxygen or not, i.e., depending on whether the fuel-air mixture is lean or rich. When the oxygen sensor is not ready for operation, for example when it is not yet at its normal operating temperature, the signal which it generates cannot readily be used or provisions must be made to adapt the system to processing an abnormal signal. Known in the art is a device for use within a sensor-control fuel injection system which completely turns off the control process when the λ-sensor is found to be input non-operational and which switches the system over to forward open-loop control. Further circuits then adapt the threshold voltage with the increasing λ-output signal after the control process is reengaged until the sensor is found to be operating completely normally. In this known apparatus, very complicated circuitry is required to achieve the desired result.

OBJECT AND SUMMARY OF THE INVENTION

It is a principal object of the present invention to provide a fuel-air mixture control system for regulating the combustible mixture for an internal combustion engine in which the threshold signal which is to be compared with the output voltage of the oxygen sensor is so changed that it remains at all times between the two values of the signal which the oxygen sensor supplies even when the sensor is not at its normal operational temperature, for example when it is cooling or cold. In this manner, the normal control process of the engine is assured even when the λ-sensor may be located in an unfavorable location. To attain this and other objects the invention provides a detector circuit for monitoring the oxygen sensor signal and a threshold adjustment circuit which is controlled by the detector circuit. The threshold adjustment circuit engages the voltage divider circuitry in that portion of the circuit which provides the threshold value. By comparison with the prior art, the present invention has the distinctive advantage of being relatively simple to construct and being capable of continuously adjusting the threshold voltage to the changing status of the λ-sensor and its signal. It is a further advantage of the present invention that it does not have an effect on the system when the λ-sensor is at normal operating temperature, and thus the presence of the circuitry of the present invention need not be considered in the design of the circuit with respect to normal operation. It is an advantageous feature of the invention that the threshold adjustment is performed by a single active element, for example a transistor, whose collector-emitter path is connected in parallel with the voltage divider circuit which generates the threshold voltage. By suitable control of this transistor, the threshold voltage can be shifted and can be adapted to the changing oxygen sensor output voltage and in particular, to the lower extreme value of that sensor voltage. The invention may be used in any type of mixture preparation system for internal combustion engines, for example those using fuel injection systems or carburetors of any kind.

The invention will be better understood as well as further objects and advantages thereof become more apparent from the ensuing detailed description of a preferred exemplary embodiment taken in conjunction with the drawing.

DESCRIPTION OF THE PREFERRED EMBODIMENT

Figure 1:
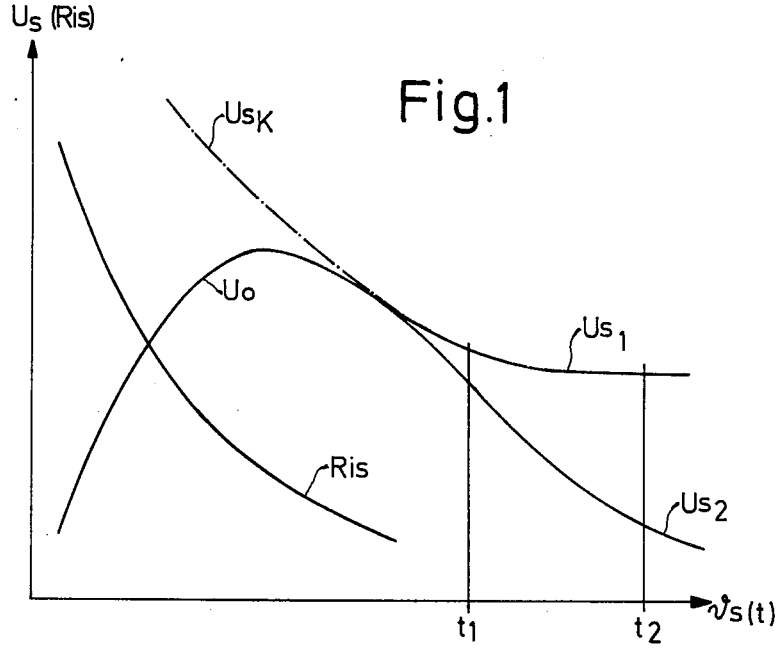
FIG. 1 is a diagram illustrating the behavior of the output voltage and the internal resistance in an oxygen or λ-sensor as a function of time or temperature.
Figure 1A:
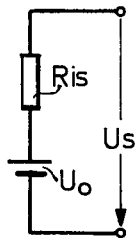
FIG. 1*a* is the equivalent circuit of a λ-sensor.

As previously mentioned, the primary control signal of the fuel mixture control system is that generated by a so-called λ-sensor which is an oxygen sensing element disposed in the exhaust system of an internal combustion engine and which generates an output voltage which switches back and forth between two extreme values depending on whether oxygen is or is not present in the exhaust gas. This signal may be interpreted to imply that the supplied fuel-air mixture is leaner or richer than the stoichiometric mixture. A control system of this type can be effectively used by permitting the engine of the vehicle to represent the control path and wherein the fuel injection system or the mixture preparation system is the controller while the λ or oxygen sensor provides the instantaneous value of the controlled variable to the controller. The equivalent circuit of an oxygen sensor of this type is illustrated in FIG. 1*a* in which is shown its internal resistance $R_{is}$ as well as the EMF $U_o$ which the sensor generates. The internal resistance $R_{is}$ and the output voltage $U_o$ are variables having a high temperature dependence which is illustrated in the diagram of FIG. 1 plotted against time or temperature. It will be noted that when the oxygen sensor is relatively cold, its internal resistance is very high but the resistance decreases near the normal operating temperature of the sensor which is in the vicinity of 250° C. to 300° C. On the other hand, the EMF of the sensor is small at low temperatures, it rises to a maximum and then branches into two limiting values $U_{s1}$ and $U_{s2}$ which define the upper and lower limits of the output signal and which occur depending on the presence or absence of oxygen in the exhaust gas. Thus, for approximately the time $t_1$ the output signal can be used to distinguish between a rich and lean mixture in a control process. Beyond the time $t_2$ no further problems arise because the threshold voltage which is connected in opposition to the sensor output voltage or which is compared with the sensor voltage for obtaining definitive information regarding the mixture can be kept substantially constant, for example at a value of 500 mV relative to the actual output voltage of the sensor.

The output voltage $U_s$ from the sensor is fed to the input circuit of a control system which, even under the most favorable circumstances, will require a small current. The λ-sensor may also sometimes be supplied deliberately with a measuring current so as to obtain information regarding the state of the sensor in the time domain $t \leqq t_1$ and to permit an open-loop control to operate during that time.

Due to the presence of the measuring current flowing through the sensor, the input of the control system is supplied with a potential equal to the voltage drop across the internal resistance $R_{is}$ and if the λ-sensor has not reached its minimum operating temperature of approximately 300° C., this output voltage will not fall below a constant threshold value even when the engine is operated with a lean mixture. As a result, the control system no longer recognizes this state and cannot function properly. The failure of the sensor to reach proper operating temperature can also be due to prolonged idling of the engine or downhill operation.

Figure 2:
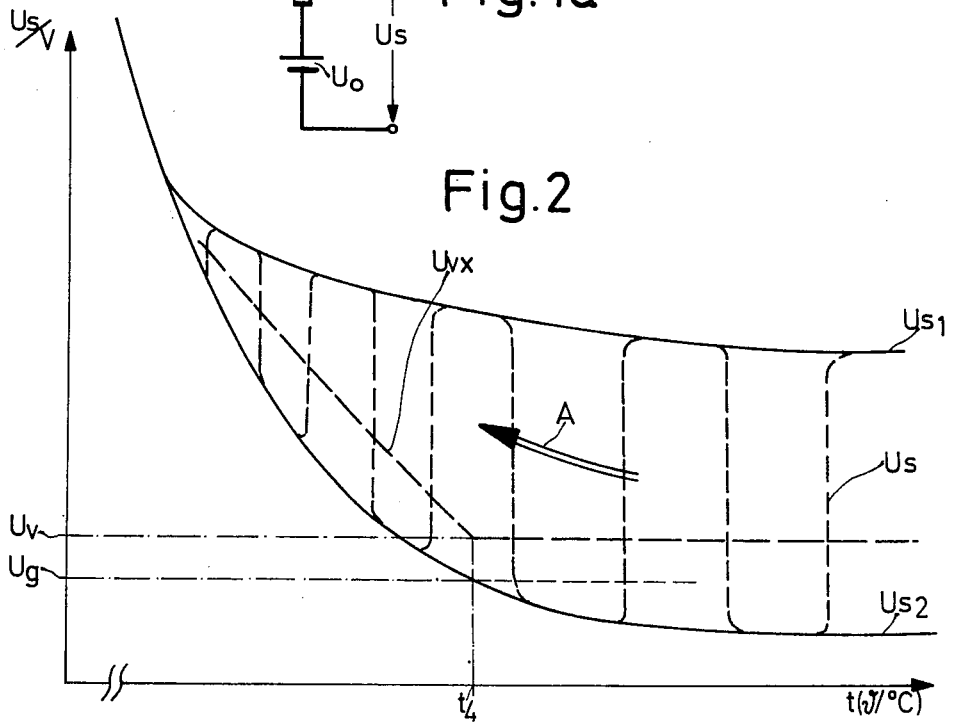
FIG. 2 is a diagram showing the important portion of the λ-sensor output voltage in which the present invention is active.
Figure 3:
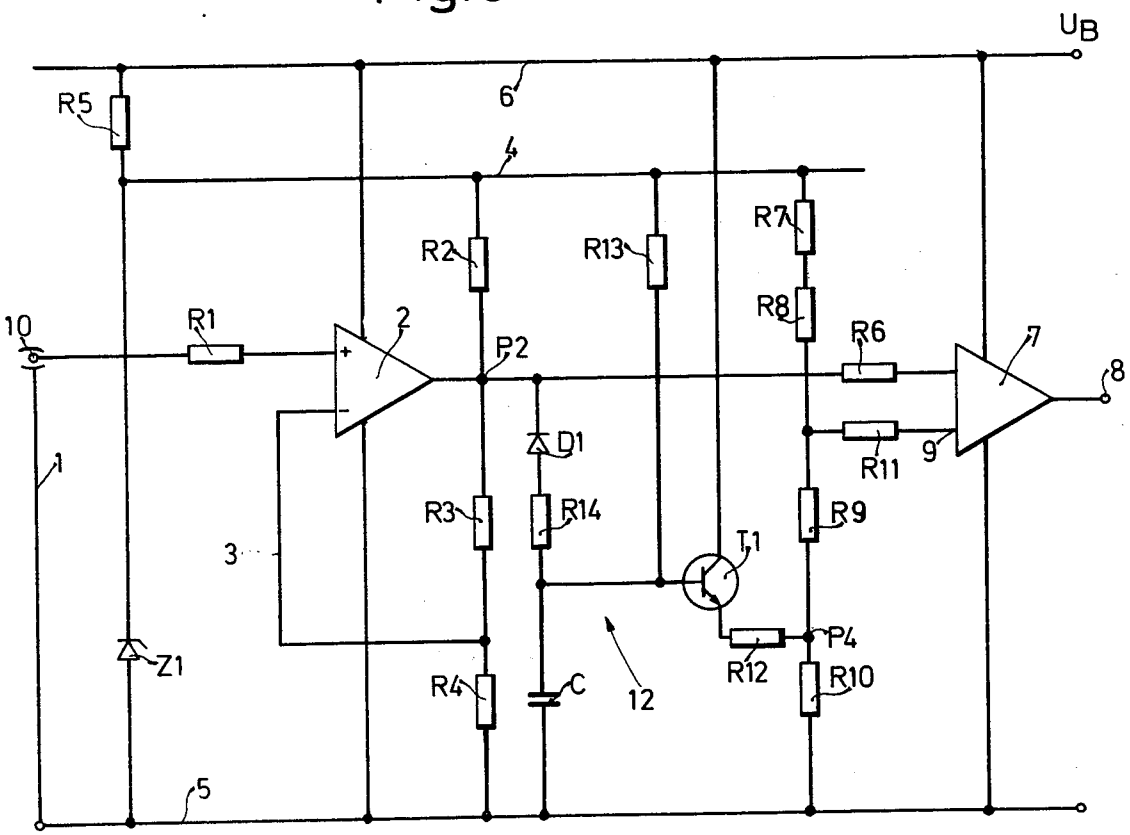
FIG. 3 is a circuit diagram of an exemplary embodiment of a circuit for adjusting the threshold voltage which may be a portion of a larger fuel mixture preparation system.

The apparatus of the invention provides means for adjusting the threshold in such a way as to insure proper controller operation when the sensor is in a status which roughly corresponds to that lying between the times $t_1$ and $t_2$ of FIG. 1. This apparatus substantially comprises a circuit the diagram of which is illustrated in FIG. 3. A λ-sensor 1 is connected directly to the input contact 10 of the circuit. The output voltage $U_s$ thus passes a resistor R1 to the input of a preliminary circuit 2, for example an operational amplifier, the other input of which receives via a line 3 a voltage which depends partly on the output voltage of the preliminary circuit 2, thereby improving the switching behavior and introducing hysteresis. The output of the pre-amplifier 2 is connected to the junction of two resistors R2 and R3 which, together with a resistor R4, constitute a voltage divider which is connected between ground and a line 4 carrying a stabilized voltage provided by another voltage divider consisting of a resistor R5 and a Zener diode Z1 connected between ground and the battery voltage of the vehicle. The feedback conductor 3 is connected to the junction of the resistors R3 and R4. As will be seen from FIG. 2, the output voltage of the preliminary stage 2 alternates abruptly between the two extreme output sensor voltages $U_{s1}$ and $U_{s2}$. As already mentioned, when the temperatures are low, the sensor output voltage is shifted in the general direction of the arrow A while the range of the excursion becomes progressively narrower. The output of the preliminary stage 2 is connected through a resistor R6 to the limit of a comparator circuit 7 which can also be an operational amplifier. The other input of the comparator receives the previously mentioned threshold voltage which is generated by a voltage divider, embodied in this case by the series connection of resistors R7, R8, R9 and R10 all connected between ground and the stabilized voltage source 4. The junction of resistors R8 and R9 is connected via a further resistor R11 to the threshold value input of the comparator 7. The output of the comparator 7 is a voltage which is either high or low depending on the composition of the mixture fed to the engine, or, more precisely, the composition of the exhaust gas, and represents the actual value signal used by the controller. In order to permit adjustment of this threshold there is provided a threshold adjustment circuit which influences the voltage supplied to the threshold input 9 of the comparator 7 and which itself receives at its input the actual sensor output voltage. In the present exemplary embodiment, this threshold adjustment circuit is a transistor T1 whose collector is connected, for example, directly to the positive supply line, whereas its emitter is connected through a resistor R12 to the junction P4 between the resistors R9 and R10. The base of the transistor T1 is connected through a resistor R13 to the stabilized voltage bus 4 and is further connected to a sensor voltage detector circuit 12 which in this embodiment is chosen to be a diode D1 connected in series with a resistor R14 and a capacitor C all connected between ground and a junction point P2 which is at the output of the preliminary circuit 2. The threshold adjustment circuit functions as follows. The capacitor C is charged to positive voltages through the resistor R13 and may be discharged through the resistor R14 and the diode D1 to the minimum value of the fluctuating sensor voltage $U_s$ (see FIG. 2). As long as the minimum output voltage $U_{s2}$ in FIG. 2 is sufficiently low, the transistor T1 will be blocked because its emitter voltage is at the voltage normally prevailing at the junction of resistors R9 and R10. In normal control operation and with the sensor at normal operating temperature, the set point or threshold value $U_v$ which the voltage divider circuit of resistors R7 to R10 supplies is approximately 500 mV. This threshold value is not altered as long as the minimum value $U_{s2}$ of the sensor voltage $U_s$ does not exceed a predetermined limit $U_g$. However, when the increasing cooling of the λ-sensor causes its lower output value to exceed the limiting value $U_g$, for example at the time $t_4$ in FIG. 2, the detector circuit 12 is no longer able to hold the voltage on the capacitor C and at the base of the transistor T1 to sufficiently small values to block the transistor T1. Thus, at the time T4 and moving to lower values of time or temperature in the diagram of FIG. 2, the base voltage of the transistor T1 becomes progressively more positive so that, from this time, the junction P4 between the resistors R9 and R10 receives an increasingly positive voltage via the collector-emitter path of the conducting transistor T1 from the positive supply line 6, thereby raising the threshold voltage $U_v$ at the input 9 to more positive values according to the threshold voltage branch $U_{vx}$ in FIG. 2 which increases substantially linearly. It will be appreciated that by appropriate choice of the values for the various circuit elements of the threshold adjustment circuit, the curve $U_{vx}$ may be placed as shown in FIG. 2 substantially between the two branches $U_{s1}$ and $U_{s2}$. Thus, even when the λ-sensor is substantially cooled off, it is possible to still obtain clear indications as to the status of the exhaust gas composition, i.e., the combustible mixture fed to the engine. As already explained, the circuit for raising the threshold voltage $U_v$ is so constructed as to change that threshold vaue only if a predetermined minimum value is exceeded by the lower sensor voltage. In this manner, this circuit does not engage the control process during normal operation, i.e., when the λ-sensor is sufficiently hot. If the λ-sensor cools off, the circuit according to the invention engages the control circuit and raises the threshold value, thereby permitting closed loop control even when the basic voltage level of the sensor is high because the threshold will continue to be traversed during the switchover of the output voltage and will thus be detected by the comparator circuit. It is suitable to so choose the values of the components and if necessary to add further components that at least the threshold voltage $U_{vx}$ lies always between the two extreme values of the output voltage $U_s$ corresponding to a lean and a rich mixture so that a closed-loop control process is possible as long as the sensor makes any distinction whatever between rich and lean mixtures. In order to prevent fluctuations of the output voltage of the detector circuit 12, i.e., the voltage at the capacitor C, which are due to the constantly alternating voltage at the output P2 of the preliminary circuit 2, this capacitor and its associated charging resistor R13 should have a time constant R13·C which is large with respect to the maximum dead time of the system.

As already mentioned, the invention may be used in association with any kind of mixture preparation system, for example those using carburetors, fuel injection systems, etc. For example, when carburetors are used, the nozzle cross section which delivers fuel to the induction tube may be changed or other parts of the carburetor may be influenced in such a way as to change the fuel-air mixture composition under the control of the output signal from the λ-sensor. The invention may also be used for controlling the exhaust gas recycling rate in fuel mixture preparation systems, for controlling the flow through bypass lines or for influencing the duration of fuel injection control pulses used in fuel injection systems, for example by entering the multiplier circuitry of such systems. More generally, the λ-sensor and its associated components including the circuit of the present invention may be used in any type of combustion systems which aspirate fuel or which deliver fuel under pressure to the combustion regions of the engines.

The foregoing relates to preferred exemplary embodiments and features of the invention, it being understood that other embodiments and variants thereof are possible within the spirit and scope of the invention.

What is claimed and desired to be secured by Letters Patent of the United States is:

1. An apparatus for controlling the composition of the combustible mixture supplied to an internal combustion engine, said engine including variable means for fuel supply and an exhaust system, and said apparatus including an oxygen sensor in said exhaust system, an oxygen sensor circuit including the oxygen sensor for generating an electrical signal related to the composition of said combustible mixture, said signal having a defined upper and lower limit which occur as a function of the oxygen content of the engine exhaust gas, said limits increasing in amplitude with decreasing temperature of said sensor, a comparator circuit for comparing said electrical signal with a variable threshold signal, a detector circuit for receiving the output from said oxygen sensor, a threshold signal adjusting circuit connected to said comparator circuit and said detector circuit, and circuit means for processing the output from said comparator circuit and for engaging said variable fuel supply means to thereby control the composition of the combustible mixture, the improvement in said detector circuit comprising:

a detector circuit for receiving the output from said oxygen sensor and a set-point generator circuit connected to said detector circuit; whereby said detector circuit engages said set-point generator to maintain the voltage of said set-point signal to be higher than the minimum oxygen sensor signal a charging circuit; and discharging means connected thereto and responsive solely to the lower limit of said oxygen sensor signal for causing an adjustment of said threshold adjustment circuit thereby maintaining the voltage of the threshold signal to be higher than the lower limit of the signal generated by the oxygen sensor circuit.

2. An apparatus as defined by claim 1, wherein said detector circuit and said threshold signal adjustment circuit cause an adjustment of said variable threshold signal only after said lower limit of said oxygen sensor signal has exceeded a limiting voltage.

3. An apparatus as defined in claim 1, wherein said threshold signal adjustment circuit includes a voltage divider circuit wherein the divided voltages are altered by said detector circuit for changing said variable threshold signal.

4. An apparatus as defined in claim 1, wherein the apparatus further includes a first differential amplifier connected to said detector circuit one input of said first differential amplifier receives said oxygen sensor signal and the other input thereof receives a voltage dependent on its output voltage to provide feedback.

5. An apparatus as defined by claim 4, wherein the comparator circuit comprises a second differential amplifier, one input of which receives the output of said first differential amplifier and the second input of which receives a signal from said detector circuit.

6. An apparatus as defined by claim 5, wherein said charging circuit includes an electrical storage element which can be discharged to a voltage equal to the lower limit of the signal generated by the oxygen sensor.

7. An apparatus as defined by claim 6, wherein said discharging means includes a resistor and a diode, wherein said electrical storage element is a capacitor one electrode of which is connected in series with the resistor and the diode to the output of said first differential amplifier, and wherein said threshold signal adjustment circuit includes a transistor whose base is connected to the remaining electrode of said capacitor.

8. An apparatus as defined by claim 7, wherein said threshold signal adjustment circuit further includes a voltage divider circuit and wherein the collector-emitter path of said transistor is connected to a point in said voltage divider circuit; whereby said threshold signal supplied to said second differential amplifier increases in magnitude when the lower limit of the signal generated by the oxygen sensor circuit increases.

9. An apparatus as defined by claim 7, wherein said charging circuit further includes a resistor connected between said capacitor and the voltage supply of the circuit to limit the charging current to said capacitor, the magnitude of said resistor and said capacitor defining a time constant which is large compared with the maximum dead time of said apparatus.

10. An apparatus as defined by claim 1, wherein said charging circuit includes a resistor and an electrical storage element connected in series with the resistor, wherein said discharging means includes a reverse bias diode connected to the electrical storage element, said detector circuit being connected by said diode with said oxygen sensor signal, and wherein the magnitude of said resistor and said electrical storage element define a time constant which is large compared with the maximum dead time of said apparatus.

* * * * *